US012569735B2

(12) United States Patent
Condez, Jr. et al.

(10) Patent No.: US 12,569,735 B2
(45) Date of Patent: Mar. 10, 2026

(54) DAMPENERS FOR SPORTING EQUIPMENT AND SPORTING EQUIPMENT INCLUDING THE SAME

(71) Applicant: VT Advantec, L.L.C., Chicago, IL (US)

(72) Inventors: Larry C. Condez, Jr., Chicago, IL (US); John Michael Long, North Canton, OH (US)

(73) Assignee: VT Advantec, L.L.C., Chicago, IL (US)

( * ) Notice: Subject to any disclaimer, the term of this patent is extended or adjusted under 35 U.S.C. 154(b) by 573 days.

(21) Appl. No.: 17/628,873

(22) PCT Filed: Jul. 22, 2020

(86) PCT No.: PCT/US2020/043128
§ 371 (c)(1),
(2) Date: Jan. 20, 2022

(87) PCT Pub. No.: WO2021/016386
PCT Pub. Date: Jan. 28, 2021

(65) Prior Publication Data

US 2022/0249928 A1 Aug. 11, 2022

Related U.S. Application Data

(60) Provisional application No. 62/892,854, filed on Aug. 28, 2019, provisional application No. 62/877,028, filed on Jul. 22, 2019.

(51) Int. Cl.
*A63B 60/54* (2015.01)
*A63B 49/08* (2015.01)
(Continued)

(52) U.S. Cl.
CPC ..... *A63B 60/54* (2015.10); *A63B 49/08* (2013.01); *A63B 49/10* (2013.01); *A63B 60/08* (2015.10);
(Continued)

(58) Field of Classification Search
CPC ..... A63B 60/08; A63B 60/18; A63B 60/54; A63B 49/08; A63B 49/10; A63B 2120/02; A63B 2209/10
(Continued)

(56) References Cited

U.S. PATENT DOCUMENTS 1,862,581 A * 6/1932 Robinson ..... A63B 51/12 473/522
1,937,787 A * 12/1933 Robinson ..... A63B 49/03 473/545
(Continued)

FOREIGN PATENT DOCUMENTS

CN 101053997 A 10/2007
CN 101065168 A 10/2007
(Continued)

OTHER PUBLICATIONS

Bu-Tylene Alu Sound | T 255 | T 1431 Sealing Tapes & Strips, pp. 1-4 (2019).
(Continued)

*Primary Examiner* — Joseph B Baldori
(74) *Attorney, Agent, or Firm* — Cook Alex Ltd

(57) ABSTRACT

This disclosure relates to dampeners for sporting equipment wherein the dampeners dampen or attenuate energy, such as vibrations or sound. The dampeners include polymeric compositions having butyl rubber polymers and, optionally, resins based on phenol-formaldehyde. The dampeners can be used in sporting equipment that requires attenuation and
(Continued)

absorption of impact, vibration, and/or sound, and the dampeners may provide cushioning to the user.

20 Claims, 4 Drawing Sheets

(51) Int. Cl.
*A63B 49/10* (2015.01)
*A63B 60/08* (2015.01)
*A63B 60/14* (2015.01)
*A63B 102/02* (2015.01)

(52) U.S. Cl.
CPC ..... *A63B 60/14* (2015.10); *A63B 2102/02* (2015.10); *A63B 2209/10* (2013.01)

(58) Field of Classification Search
USPC ..... 473/520, 521, 522, 523
See application file for complete search history.

(56) References Cited

U.S. PATENT DOCUMENTS 2,171,223 A * 8/1939 Robinson ..... A63B 49/022 473/545
2,356,128 A 8/1944 Thomas
2,626,804 A * 1/1953 Robinson ..... A63B 60/00 473/534
2,701,895 A 2/1955 Tawney
2,878,020 A * 3/1959 Robinson ..... A63B 49/11 156/247
2,972,600 A 2/1961 Braidwood
3,031,423 A 4/1962 Meier
4,022,469 A * 5/1977 Lacoste ..... A63B 39/06 525/158
4,139,194 A * 2/1979 Fischer ..... A63B 49/035 473/532
4,237,176 A 12/1980 Brueggemann et al.
4,634,124 A * 1/1987 Yuhas ..... A63B 60/54 473/521
5,018,733 A * 5/1991 Buand ..... A63B 60/54 473/550
5,106,086 A * 4/1992 Acosta ..... A63B 60/54 473/522
5,314,180 A * 5/1994 Yamagishi ..... A63B 60/54 473/535
5,374,057 A * 12/1994 Lai ..... A63B 60/54 473/521
5,651,545 A * 7/1997 Nashif ..... A63B 60/54 473/520
5,728,008 A * 3/1998 Howard ..... A63B 53/02 473/409
6,235,134 B1 5/2001 Mueller
6,293,878 B1 * 9/2001 Iwatsubo ..... A63B 60/54 473/524
6,565,463 B2 * 5/2003 Pai ..... A63B 49/02 473/521
6,623,384 B2 * 9/2003 Kanemitsu ..... A63B 60/54 473/521
6,663,514 B2 * 12/2003 Niwa ..... A63B 49/03 473/546
6,663,515 B1 * 12/2003 Pai ..... A63B 49/02 473/546
6,840,874 B2 * 1/2005 Severa ..... A63B 49/03 473/546
6,974,626 B2 12/2005 Horacek
7,012,111 B2 3/2006 Kanemitsu et al.
7,070,525 B2 * 7/2006 Wilke ..... A63B 60/02 473/524
7,077,767 B2 * 7/2006 Mauser ..... A63B 59/00 473/536
7,144,961 B2 12/2006 Nakabayashi
7,181,891 B2 2/2007 Surace et al.
7,297,080 B2 * 11/2007 Severa ..... A63B 49/03 473/546
7,625,625 B2 * 12/2009 Rios ..... B32B 27/20 156/60
7,669,290 B2 3/2010 Oddo et al.
7,798,287 B1 9/2010 Surace et al.
7,908,818 B2 3/2011 Tinianov et al.
7,909,136 B2 3/2011 Surace et al.
7,921,965 B1 4/2011 Surace
7,946,937 B2 * 5/2011 Searle ..... A63B 60/00 473/539
8,029,881 B2 10/2011 Surace et al.
8,102,478 B2 1/2012 Xue
8,137,221 B2 * 3/2012 Ashino ..... A63B 49/10 473/535
8,181,417 B2 5/2012 Surace et al.
8,181,738 B2 5/2012 Tinianov et al.
8,337,993 B2 12/2012 Surace et al.
8,357,449 B2 1/2013 Neubert et al.
8,397,864 B2 3/2013 Tinianov et al.
8,402,716 B2 3/2013 Tinianov et al.
8,424,251 B1 4/2013 Tinianov
8,495,851 B2 7/2013 Surace et al.
8,951,150 B2 * 2/2015 Mace ..... A63B 49/038 473/522
9,630,077 B2 4/2017 Mikura et al.
10,087,345 B2 10/2018 Yoshida et al.
10,287,465 B2 5/2019 Tanaka et al.
10,336,046 B2 7/2019 Liu et al.
10,376,762 B2 8/2019 Solheim et al.
11,053,415 B2 7/2021 Chai
2002/0039521 A1 4/2002 Votsch
2002/0165050 A1 11/2002 Severa et al.
2003/0040384 A1 2/2003 Falone
2004/0048698 A1 * 3/2004 Kanemitsu ..... A63B 49/02 473/520
2004/0224151 A1 11/2004 Horacek
2004/0234445 A1 11/2004 Serp
2005/0009649 A1 * 1/2005 Okamoto ..... A63B 60/10 473/521
2005/0181896 A1 8/2005 Severa et al.
2006/0135296 A1 * 6/2006 Lammer ..... A63B 60/54 473/520
2006/0157901 A1 7/2006 Vito et al.
2008/0102240 A1 5/2008 Serra et al.
2008/0108451 A1 5/2008 Han
2009/0179361 A1 7/2009 Vito et al.
2010/0189947 A1 7/2010 Serra et al.
2011/0059281 A1 3/2011 Wada
2011/0070430 A1 3/2011 Shirai et al.
2012/0000504 A1 1/2012 Bengtson et al.
2012/0082818 A1 4/2012 Wada et al.
2012/0255677 A1 10/2012 Kigami et al.
2014/0121034 A1 5/2014 Novak
2014/0287638 A1 9/2014 Hadley
2014/0339037 A1 11/2014 Kawaguchi
2015/0072809 A1 * 3/2015 Palumbo ..... A63B 59/70 473/560
2015/0247066 A1 9/2015 Ramirez
2015/0367211 A1 12/2015 Lyons et al.
2016/0184672 A1 6/2016 Wang
2016/0184682 A1 6/2016 Wang
2016/0346656 A1 12/2016 Wang
2016/0377139 A1 * 12/2016 Vito ..... B32B 5/024 267/141
2018/0291235 A1 10/2018 Ohmori et al.
2019/0031922 A1 1/2019 Choi et al.
2019/0314693 A1 10/2019 Solheim et al.
2020/0165497 A1 5/2020 Ikeda et al.
2021/0277283 A1 9/2021 Townsend et al.
2022/0073739 A1 * 3/2022 Peters ..... C08L 75/04

FOREIGN PATENT DOCUMENTS

CN 101072665 A 11/2007
CN 100363430 C 1/2008
CN 101288800 A 10/2008
CN 102423938 A 4/2012

(56) References Cited

FOREIGN PATENT DOCUMENTS

| | | | |
|---|---|---|---|
| CN | 103143150 | A | 6/2013 |
| CN | 104083858 | A | 10/2014 |
| CN | 105477838 | A | 4/2016 |
| CN | 108137121 | A | 6/2018 |
| CN | 108330556 | A | 7/2018 |
| CN | 108341948 | A | 7/2018 |
| DE | 2757430 | C2 | 12/1998 |
| EP | 1016691 | A1 | 7/2000 |
| JP | 2000197720 | A | 7/2000 |
| JP | 3334825 | B2 | 10/2002 |
| JP | 2002284896 | A | 10/2002 |
| JP | 2004052939 | A | 2/2004 |
| JP | 2004141196 | A | 5/2004 |
| JP | 3742905 | B2 | 2/2006 |
| JP | 2006341102 | A | 12/2006 |
| JP | 4097894 | B2 | 6/2008 |
| JP | 2013027491 | A | 2/2013 |
| JP | 2013135771 | A | 7/2013 |
| JP | 2016093333 | A | 5/2016 |
| JP | 2019080841 | A | 5/2019 |
| KR | 101587929 | B1 | 1/2016 |
| TW | 386225 | B | 4/2000 |
| TW | 559257 | U | 10/2003 |

OTHER PUBLICATIONS

Model vulcanization systems for butyl rubber and halobutyl rubber manual, pp. 1-28.

International Search Report and Written Opinion Dated Oct. 8, 2020 for International Application No. PCT/US2020/043128.

Supplementary European Search Report for European U.S. Appl. No. 20/844,144 Dated Apr. 25, 2023.

Kang Y, Taton TA. Micelle-encapsulated carbon nanotubes: a route to nanotube composites. J Am Chem Soc. May 1, 20034; 125(19):5650-1. doi: 10.1021/ja034082d. PMID: 12733901.

Wang Y, Iqbal Z, Mitra S. Rapidly functionalized, water-dispersed carbon nanotubes at high concentration. J Am Chem Soc. Jan. 1, 20061;128(1):95-9. doi: 10.1021/ja053003q. PMID: 16390136.

* cited by examiner

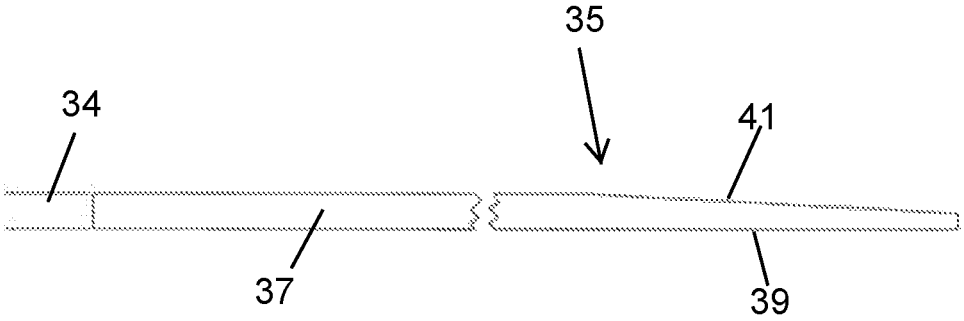
*Fig.* 6A

DAMPENERS FOR SPORTING EQUIPMENT AND SPORTING EQUIPMENT INCLUDING THE SAME

The present application is the U.S. National Stage Application of PCT Application No. PCT/US2020/043128, filed Jul. 22, 2020, which claims the benefit of and priority to U.S. Provisional Patent Application No. 62/877,028, file Jul. 22, 2019, and U.S. Provisional Patent Application No. 62/892,854, file Aug. 28, 2019, all of both for which are hereby incorporated herein by reference.

FIELD OF THE INVENTION

This disclosure relates to dampeners for sporting equipment wherein the dampeners dampen or attenuate energy, such as vibrations or sound. The dampeners include polymeric compositions having butyl rubber polymers and, optionally, resins based on phenol-formaldehyde. The dampeners can be used in sporting equipment that requires attenuation and absorption of impact, vibration, and/or sound, and the dampeners may provide cushioning to the user. The present disclosure also relates to sporting equipment including such dampeners.

BACKGROUND

Several types of sports equipment are used for striking, hitting and/or absorbing impact. It is oftentimes desired to dampen excess energy during use of the sports equipment to protect the user. While a variety of materials cater to such needs for attenuation and absorption, an unfulfilled need exists for a material that will provide an improvement in attenuation and absorption of impact, vibration, and sound for sporting equipment.

Therefore, there remains a need for sporting equipment and devices for sporting equipment that attenuates and/or dampens energy during the use of the device.

SUMMARY OF INVENTION

In one aspect, sports equipment that includes a body and a vibration dampener associated with the body, wherein the vibration dampener comprises a polymeric composition comprising a butyl rubber.

In another aspect, a vibration dampener for sports equipment that includes a layer comprised of a polymeric composition comprising a butyl rubber, wherein the layer is configured to be attached to sports equipment.

The vibration dampeners may be a shape selected from strips, sheets, films, strings, ropes, fibers, chips, rings, forms, molds, slabs, tapes, coatings, perforated sheets, corrugated structures, beads, foams and laminates.

BRIEF DESCRIPTION OF DRAWINGS

FIG. 6A is a top view enlarged view of the one end of the dampener of FIG. 6;

DETAILED DESCRIPTION

Definitions

Figure 1:
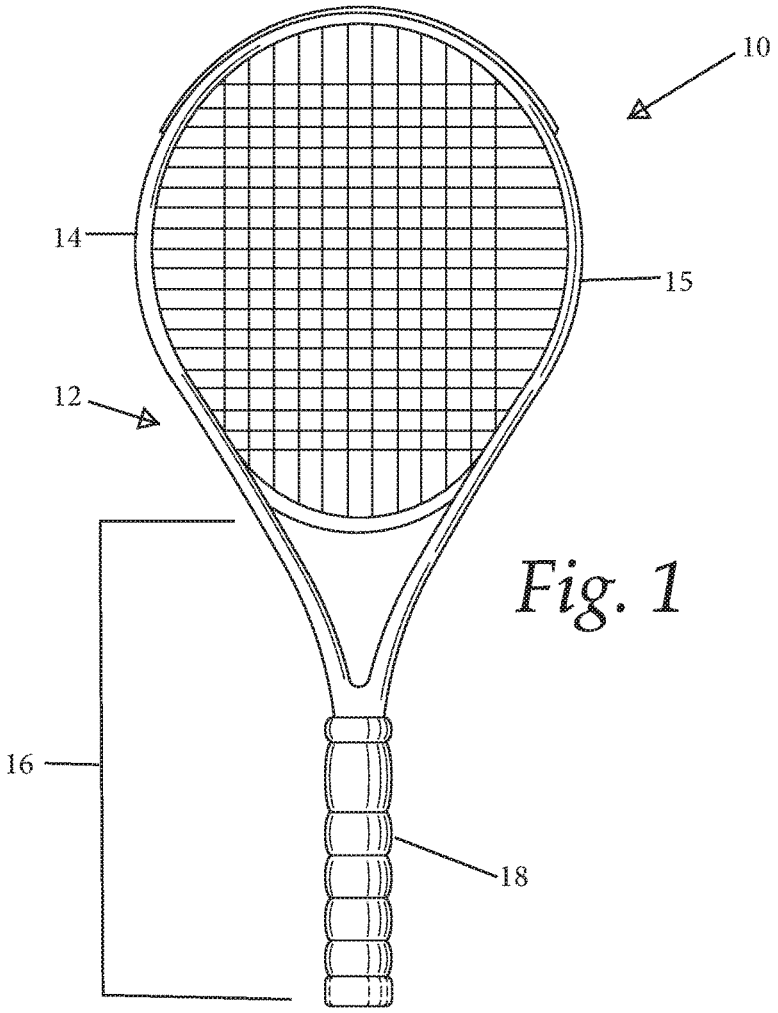
FIG. 1 is a front elevation view of a sports equipment.

All percentages expressed in the present patent application are by weight of the total weight of the composition unless expressed otherwise.

All ratios expressed in this patent application are on a weight: weight basis unless expressed otherwise.

In this patent application, ranges are used as shorthand only to avoid listing and describing each and every value within the range. Any appropriate value within the range can be selected as the upper value, the lower value, or the end-point of the range.

In this patent application, the singular form of a word includes it's plural, and vice versa, unless the context clearly dictates otherwise. Thus, references "a," "an," and "the" generally include the plurals of the respective terms they qualify. For example, reference to "a method" includes its plural "methods." Similarly, the terms "comprise," "comprises," and "comprising," whether used as a transitional phrase in the claims or otherwise, should be interpreted inclusively rather than exclusively. Likewise the terms "include," "including," and "or" should be construed to be inclusive, unless such a construction is clearly prohibited from the context. Similarly, the term "examples," particularly when followed by a listing of terms, is merely exemplary and illustrative and should not be deemed to be exclusive or comprehensive.

The methods, compositions, and other advances disclosed in this patent application are not limited to particular methodology, protocols, and reagents described in the application because, as the skilled artisan will appreciate, they may vary. Further, the terminology used in this application describes particular embodiments only, and should not be construed as limiting the scope of what is disclosed or claimed.

Unless defined otherwise, all technical and scientific terms, terms of art, and acronyms used in the present application have the meanings commonly understood by one of ordinary skill in the art in the field(s) of the invention, or in the field(s) where the term is used. Although any compositions, methods, articles of manufacture, or other means or materials similar or equivalent to those described in the present patent application can be used in the practice of the present invention, specific compositions, methods, articles of manufacture, or other means or materials are described only for exemplification.

All patents, patent applications, publications, technical and/or scholarly articles, and other references cited or referred to in this patent application are incorporated in their entirety by reference to the extent allowed by law. The discussion of those references is intended merely to summarize the assertions made in these references. No admission is made that any such patents, patent applications, publications or references, or any portion thereof, are relevant, material, or prior art. The right to challenge the accuracy and pertinence of any assertion of such patents, patent applications, publications, and other references as relevant, material, or prior art is specifically reserved.

In some applications, the formulations of the present disclosure show unexpected and a surprising improvement over an exemplary polyurethane based material currently available for example for dampening purposes. More specifically, the formulations of the polymeric compositions show at least about 20% to about 500% improvement in the tan delta value, that is the ratio of the loss modulus over the storage modulus of the material, during the dynamic mechanical analysis of article made from such formulation measured at room temperature and various frequencies.

In one embodiment, the polymeric composition comprises a butyl rubber cured with a phenol-formaldehyde resin or sulfur, at least one filler, and optionally stearic acid and a mineral oil. Component of the uncured formulation are described below. This present disclosure relates to both the uncured and the cured formulations described herein. Alternatively, the polymeric composition could include any suitable polymer that dampens or attenuates energy so as to reduce the vibration and frequency during use.

Turning to the figures, the present disclosure is directed towards dampeners for sports equipment. The dampeners or vibration dampeners may dampen and/or attenuate vibrations, sounds and/or other forms of energy that are generated during use of the sports equipment. The dampeners may be integral with the sporting equipment or may be attached to or otherwise associated with sporting equipment. Although the dampeners may be described herein in relation to certain sports equipment, such descriptions are meant to be exemplary and the dampeners may be applied to any sports equipment. Such sport equipment includes, but is not limited to, racquets (tennis, racquet ball, badminton etc.) paddles (ping-pong, pickleball, tennis, platform tennis, etc.), sticks (hockey, lacrosse, etc.), clubs (golf, etc.), bats (baseball, softball, cricket, etc.), hats, gloves (baseball, hockey, golf, etc.), shoes, pads (football, soccer, hockey lacrosse, shin, knee, shoulder, etc.) and helmets and headgear (football, baseball, bike, auto-racing, hockey, soccer, wrestling, etc.).

In one embodiment, the sports equipment includes a body and a dampener associated with the body. The dampener includes a polymeric composition. In one embodiment, the polymeric composition may be a composition comprising a butyl rubber, such as any of the butyl rubber containing polymeric composition disclosed herein. In an alternative embodiment, the polymeric composition could be any polymer composition that dampens or attenuates energy so as to reduce the vibration and frequency during use, therefore enhancing the user's experience of the sports equipment. For example, the polymeric composition could include any suitable polymer. Optionally, the polymeric composition may include other components as well. In one embodiment, the polymeric composition may include a polymer and a metal. For example, the polymeric composition may include a polymer and tungsten. In one embodiment, the polymeric composition may include polyether block amide and tungsten. In other embodiments, the polymeric composition could include Aflas, Chlorosulfonated Polyethylene, Epichlorohydrin, Ethylene Propylene, Fluoroelastomer, Fluorosilicone, Hydrogenated Nitrile, Natural Rubber, Nitrile, Perfluoroelastomer, Polyacrylic, Polychloroprene, Polyurethane, Silicone, Styrene Butadeine, Foam, Plastics, Sheet Stock, Moon Gels, Aero Gels, Basalt, and Tungsten.

As mentioned above, the dampener may be integral or one-piece with the body, and/or may be attached to or otherwise associated with the body. In one embodiment, the body of the sports equipment includes a frame and the dampener is associated with the frame. In another embodiment, the body includes a shaft and the dampener is associated with the shaft. If a shaft is hollow, the dampener may be applied inside of the shaft via insertion of a solid or particles or a foam spray type application. If a frame is hollow, the dampener could be placed inside of a hollow frame, during a manufacturing process in form of a foam, spray, beads or strips. Additionally, the dampening material could replace the grommet of a tennis racquet. The body also may include a handle, wherein the dampener is associated with the handle.

The dampener may comprise a layer of the polymeric composition that is part of the body of the sports equipment or is attached to the body. The layer of the polymer composition may be in the form of a strip or a sheet. The strip may be an elongated, narrow strip that is longer than it is wide. The strip may be pre-cut into a desired size. Alternatively, the strip may be provided on a roll or as a tape wherein the user may custom cut the strip to a desired size. When in a sheet, the sheet may be configured to cover a relatively larger size than a strip. The sheets may be regular or irregular shapes. For example, the sheets may be square, rectangular, circular, oval, etc. or the sheets may be in a custom shape or be configured to be cut into a custom shape.

In one embodiment, the dampener may be a strip or tape that includes the layer of the polymer composition and an adhesive layer for attaching the strip or tape to the body of the sports equipment. Optionally, the strip or tape may include a gripping material, which assists in the user gripping the sports equipment. The layer of gripping material may be, for example, real or synthetic leather, a polymer layer or synthetic polymer layer. The gripping material may have an outer surface that is intended to be gripped by a user's hand. The outer surface may be textured or tacky to assist in gripping. The gripping material may be attached to the layer of polymer composition in any suitable manner, such as by adhesive, heat, meshing etc. In one embodiment, the adhesive may be between the layer of gripping material and the layer of the polymer composition.

Optionally, the dampener may include a plurality of strips or sheets. The strips or sheets may be located at different locations on the body of the sports equipment.

Optionally, the dampener may be a sleeve that has a bore for receiving a portion of the sports equipment. The sleeve may be formed by molding or cutting the polymeric composition. In one embodiment, the sleeve is configured to be positioned over a handle. The sleeve may have an outer surface that is configured for gripping by the hand. For example, the sleeve may include the polymer composition wherein the outer surface of the polymer composition includes a texture or other gripping surface. Optionally, the sleeve may include a layer of gripping material over the polymer composition.

Turning back to FIG. 1, there is shown a tennis racquet 10 that has a body 12. The body 12 includes a head 14 including a beam 15. The body also includes a shaft 16 and handle 18.

Figure 2:
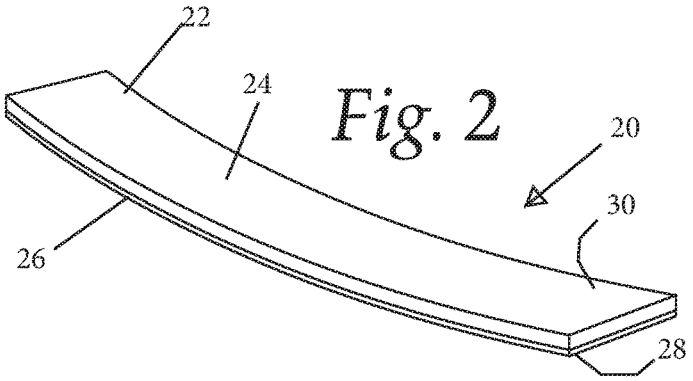
FIG. 2 is a perspective view of one embodiment of a dampener in accordance with the present disclosure.

FIG. 2 illustrates an exemplary embodiment of a dampener 20. In this example, the illustrated dampener 20 is a strip 22. The strip 22 could be provided as individual precut strips or could be provided as a roll or tape (not shown), wherein the user may custom cut the strips 22 to size. The strip 22 includes a layer 24 of polymeric composition, such as any of those disclosed herein. In one embodiment, the polymeric composition may contain butyl rubber, such as any of the butyl rubber compositions disclosed herein.

Optionally, the strip 22 could include an adhesive layer 26 for attaching the strip 22 to sports equipment. When adhesive layer 26 is included, the strip may also include a release layer or liner (not shown) over the bottom surface 28 of the adhesive layer 26. The release liner is removed to apply the strip 22 to the sports equipment. Optionally, the strip 22 could include a backing layer (not shown) over a top surface 30 of the polymeric composition layer 24. The backing layer could be to protect the polymer material and/or could include decorations, sayings or images.

The strips may be virtually any length and width depending on the desired use and the sports equipment to which it is attached. In one embodiment, the strip has a length of about 7.62 cm to about 15.24 cm, a width of about 0.635 cm to about 0.76 cm and a thickness of about 15 mils (0.015 inches) to about 60 mils (0.060 inches).

The polymer material of the strips and/or the dampener 34 described below may be any of the polymer materials disclosed herein (such as the butyl rubber materials) and may have one or more of the following:

- Tensile Strength between about 600 psi/min and about 800 psi/min, as measured by ASTM D412. Preferably between about 680 psi/min and about 750 psi/min, and more preferably about 722 psi/min.
- Elongation between about 900% and 1000%, as measured by ASTM D412. Preferably between about 950% and about 997%, and more preferably about 985%.
- Tear Strength between about 100 pli and about 200 pli, as measured by ASTM D624. Preferably between about 110 pli and about 135 pli, and more preferably about 129 pli.
- Shore A Hardness between about 40 and about 55, as measured by ASTM D2240. Preferably between about 44 and about 55, and more preferably about 53.
- Bashore Rebound between about 3% and about 7%, as measured by ASTM D2632. Preferably between about 4% and about 6%, and more preferably about 5%.
- Ultimate Tensile Strength between about 900 psi/min and about 1000 psi/min, as measured by ASTM D412. Preferably between about 970 psi/min and about 990 psi/min, and more preferably about 985 psi/min.
- Ultimate Elongation between about 680% and 740%, as measured by ASTM D412. Preferably between about 700% and about 730%, and more preferably about 722%.

Figure 3:
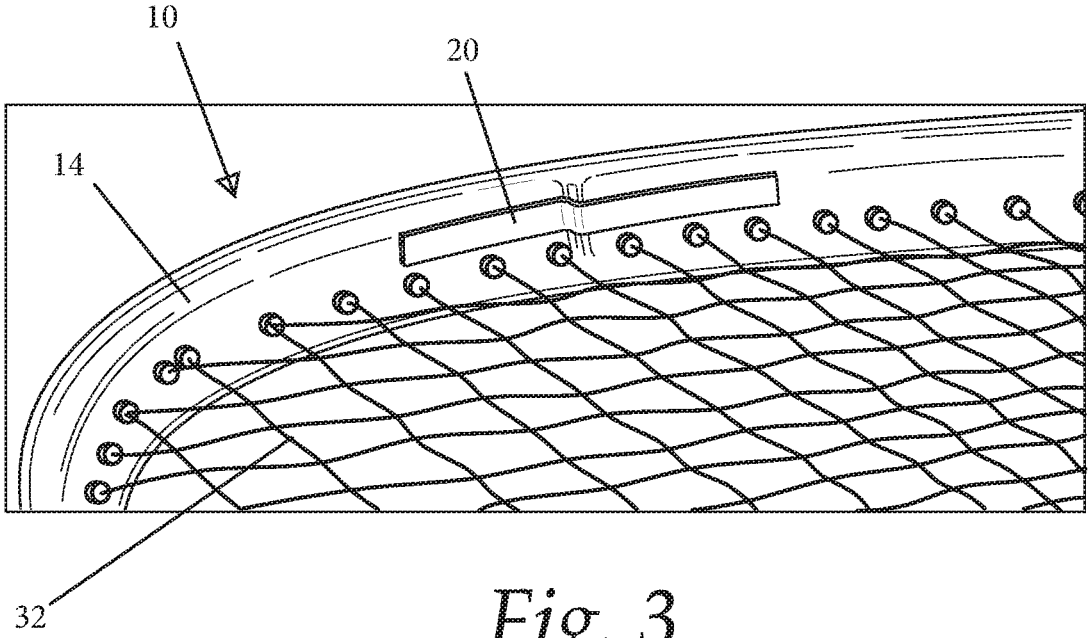
FIGS. 3-5 are perspective views showing positioning of the dampener of FIG. 2 on a sports equipment.
Figure 4:
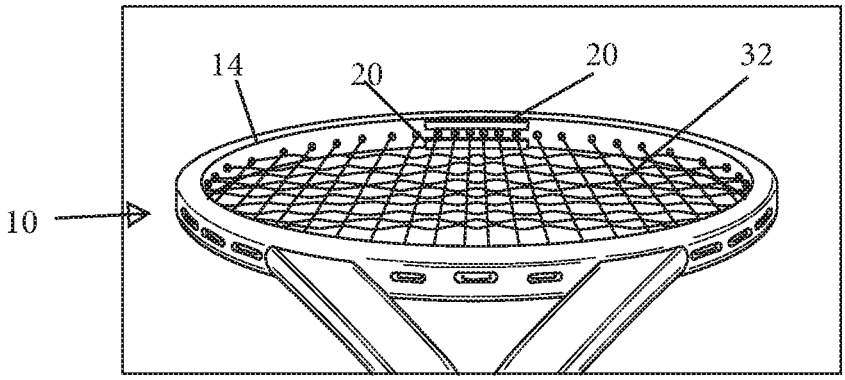
Figure 5:
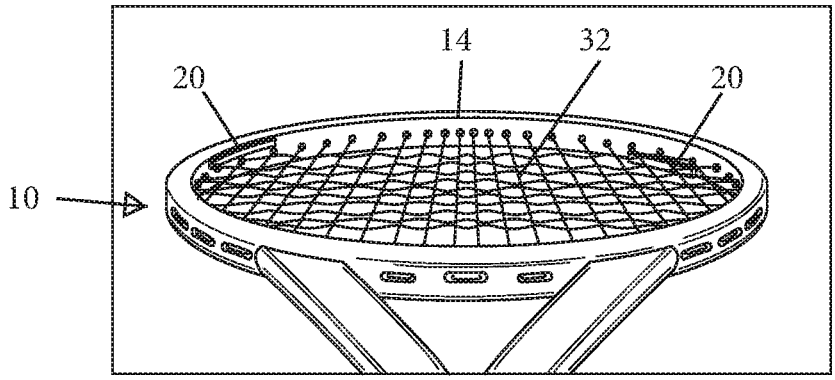

Turning now to FIGS. 3-5, these figures provide examples of dampeners 20 being attached to sports equipment, such as the illustrated tennis racquet 10. The size, number and placement of the dampeners on the sports equipment may be customizable. That is, the size of the dampener could be virtually any size, the number of dampeners could be any number, and the dampener(s) could be placed at any location. In FIG. 3, a dampener 20 is attached to the beam of the head 14 on one side of the strings 32. In FIG. 4, a dampener 20 is placed on the inside of the beam at the top of the head 14 on one side of the strings 32. Optionally, a dampener 20 may be placed on the beam of head 14 on the other side of the strings 32. The dampeners 20 may be aligned or may be offset. In FIG. 5, a dampener 20 is placed on the beam on one side of the head 14 and one side of the strings 32. Optionally, a dampener 20 may be placed on the beam on the other side of the head 14 and the other side of the strings 32. Alternatively, dampeners 20 may be placed on the same side of the head 14 and opposite side of the strings 32. Also alternatively, dampeners 20 may be placed on opposite sides of the head 14 and the same side of the strings 32. While the racquet is shown with two dampeners, it will be understand that there could be more than two dampeners and that the dampeners could be placed in any number of various positions. Additionally, the dampeners could be placed on the outside of the beam or inside of a hollow beam.

Figure 6:
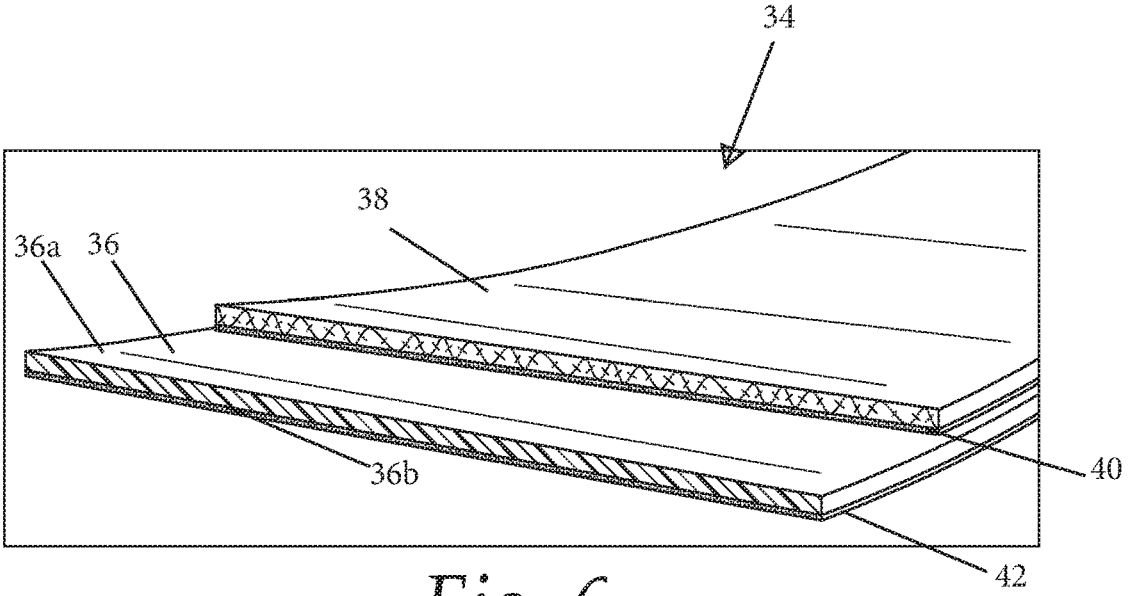
FIG. 6 is a perspective view of another embodiment of a dampener in accordance with the present disclosure.
Figure 7:
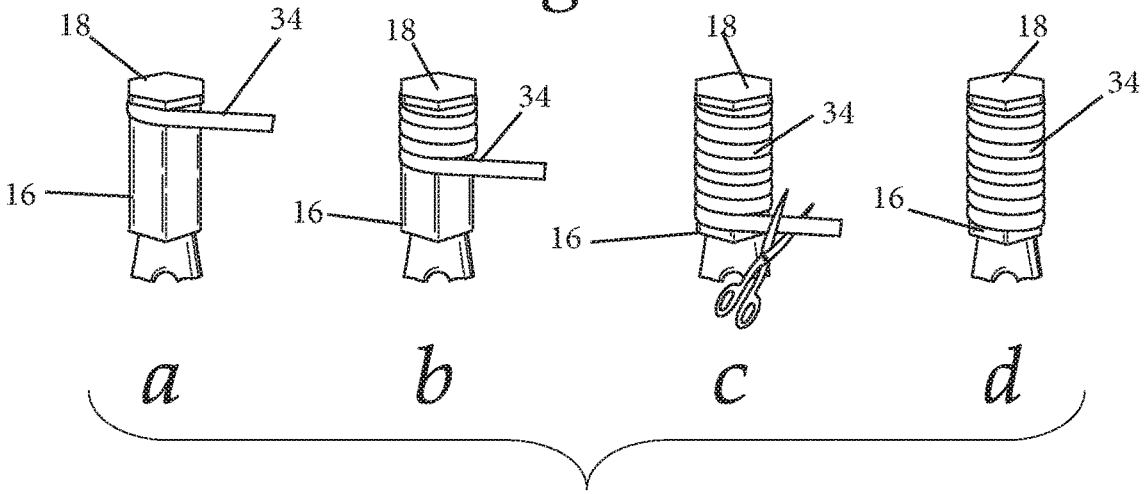
FIGS. 7*a-d* are perspective views showing the dampener of FIG. 6 being applied to a handle of a sporting equipment.

Turning now to FIG. 6, there is shown an embodiment of another dampener 34. Dampener 34 could be provided as a strip, sheet or tape. The dampener 34 includes a layer of polymeric composition 36 and an outer layer or layer of gripping material 38. The layer of polymeric composition 36 and the outer layer 38 may be bonded to each other in any suitable manner. For example, a layer of adhesive 40 may be used to bond the polymeric composition layer 36 to the outer/gripping layer 38. In another embodiment, the layers could be bonded by heat or the outer layer 38 could be meshed with the polymeric composition layer 36. Optionally, the dampener could also include a layer of adhesive 42 for attaching the dampener to sporting equipment. When a layer of adhesive 42 is not present, the polymeric composition layer may be applied directly to the surface of the sporting good. For example, the polymer composition, such as the butyl rubber compositions disclosed herein, may have sufficient tack so that the dampener 34 (strip, sheet or tape) can be applied directly to the surface of the sporting good without the use of an intervening adhesive layer. That is, the polymer composition may have sufficient tackiness such that when employed without an adhesive layer, the dampener sufficiently attaches, sticks or is mounted on the sporting good. Referring to FIG. 6A, there is shown an enlarged top view of one end portion 35 of the dampener 34. The end portion 35 includes a top surface 37 and opposed side 39 and 41. One or both of the side portions 39 and 41 may tapere inwardly in the direction of the terminal end of the dampener. This may be a continuous taper or taper may level out toward the terminal end of the dampener.

The layer of polymeric composition 36 may have a thickness as measured between the top surface 36*a* and bottom surface 36*b* of between 14 mils (0.014 inches) and 25 mils (0.025 inches), preferably about 0.018. The length and width of the layer of polymeric composition may vary depending on its intended use. In one embodiment, the length may be about 50 inches and width may be about 0.50 inches. The layer of polymer composition 36, which may be any of the polymer compositions described herein, may be formed by a calendering process. In such a process, the polymer is heated and calendered between two or more rollers to form a continuous sheet. The thickness of the sheet may depend on the size of the gap between the last two rollers. Optionally, the calendaring process could include a set of rollers that form a surface finish. For example, they can influence the glossiness and texture of the surface. Optionally, the process of forming the layer of polymeric composition may include vulcanization of the polymer. After the sheet is formed, the sheet is cut into desired shapes, such as into strips/tape. The cutting may be conducted in any suitable manner, such as laser, water jet or die cutting. When adhesive and gripping layers are used, these layers may be applied before or after cutting the sheets into the desired shape.

In one embodiment, the polymer layer of dampener 34 and/or the strips 20 disclosed above may be any of the polymer materials disclosed (such as the butyl rubber materials) herein and may have one or more of the following:

- Shore A Hardness between about 45 and about 75, as measured by ASTM D2240. Preferably between about 55 to about 65, and more preferably about 60.
- Tensile Strength between about 1,050 psi/min and about 1950 psi/min, as measured by ASTM D412. Preferably between about 1,400 psi/min to about 1,600 psi/min, and more preferably about 1,500 psi/min.
- Elongation of between about 300% and 400%, as measured by ASTM D412. Preferably between about 325% to 375%, and more preferably about 350%.

In FIGS. 7*a-d,* the dampener 34 is provided as a tape, roll or elongated strip that is applied to a shaft or handle of sports equipment, such as the shaft 16 or handle 18 of a tennis racquet. The dampener 34 may be wound about the shaft 16 or handle 18 and then cut. As mentioned above, the dampener 34 may include a bottom adhesive layer 42 (FIG. 6) for attaching the dampener to the handle. Alternatively, when the polymer composition 36 has sufficient tackiness, the dampener may not include an intervening adhesive layer and the polymer composition 36 may be applied directly to the surface of the handle. The dampener 34 can form or form part of the overgrip or undergrip of a tennis racquet. Furthermore, the dampener 34 could be placed on the racquet during manufacturing. Alternatively, a user could apply the dampener to the racquet after market.

Figure 8:
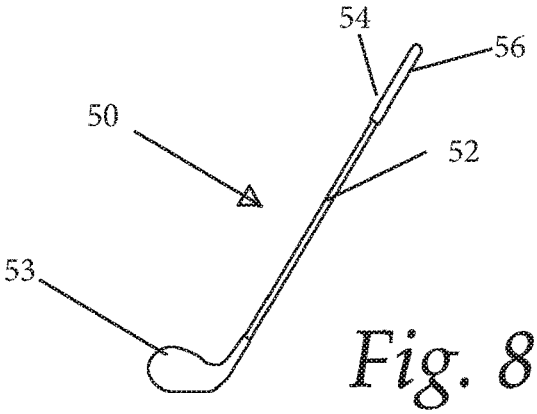
FIG. 8 is a perspective view of another sports equipment.
Figure 9:
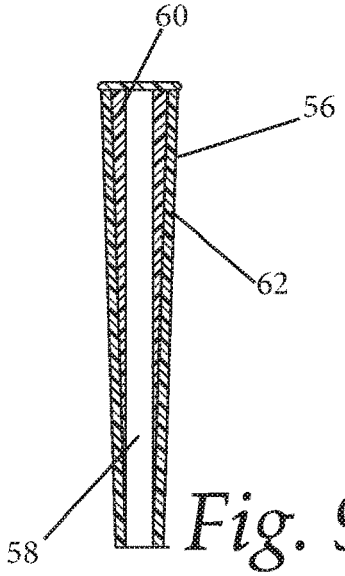
FIG. 9 is a cross-sectional view a sleeve of the sports equipment shown in FIG. 8.

Turning to FIGS. 8 and 9, there is shown a sports equipment, such as a golf club 50 having a shaft 52. The shaft 52 includes a grip 54 in the form of a sleeve 56. As illustrated in FIG. 9, the sleeve 56 includes a bore 58 for receiving the shaft 52. The sleeve 56 may be made of or contain the polymeric composition. The sleeve 56 may be molded or cut into the desired sleeve shape. Optionally, the sleeve may include a core 60 made of the polymeric composition and an outer layer 62 made of a gripping material. Optionally, one or more dampening strips, such as any of those disclosed herein, may be placed on the shaft 52 or the golf club head 53.

Butyl Rubber

Butyl rubber is a copolymer of isobutylene with small amounts of isoprene. Butyl rubber in the uncured state is a weak material having the typical properties of a plastic gum; it has no definite elastic limit, that is, upon slow application of tensile stress, it elongates almost indefinitely without breaking, and exhibits virtually no elastic recovery after the stress is removed. On the other hand, vulcanized or cured butyl rubber is a strong, non-plastic material; it has an elastic limit, as well as the ability to return substantially to its original length after being stretched as much as several hundred per cent.

In one embodiment of the present disclosure, the unsaturation in the butyl polymer or butyl rubber, which comes from the isoprene component, may simultaneously impart the dampening properties, as well as anti-ageing properties, and the anti-microbial properties of the polymeric formulation. In one embodiment, the range of unsaturation of the butyl rubber is 1.65-2.60 mole % unsaturation. In another embodiment, the unsaturation is from 0.7 mole % to 2-45 mole %. Although lower unsaturation would result in lower cross-link density, which might provide improved dampening, it may also deteriorate the stress/strain properties and set properties. In one embodiment, the butyl rubber is cross-linked with a phenol-formaldehyde resin cure or is sulfur crosslinked. Butyl rubber is well known in the art and is described in U.S. Pat. No. 3,031,423, column 1, lines 15 to 24. The low unsaturation butyl rubber may contain 0.5 to 1.1 mole % isoprene and 98.9 to 99.5 mole % isobutylene and can be prepared by any of the well known prior art methods, e.g., as described in U.S. Pat. No. 2,356,128.

Alternatively, useful impact modifying rubbers include, for instance, thermoplastic elastomeric polymeric resins. Impact modifying rubbers may be selected from, for example, polybutadiene, polyisobutylene, ethylene-propylene copolymers, ethylene-propylene-diene terpolymers, sulfonated ethylene-propylene-diene terpolymers, polychloroprene, poly(2,3-dimethylbutadiene), nitrile-butadiene rubber (NBR), hydrogenated nitrile-butadiene rubber (HNBR), poly(butadiene-co-pentadiene), chlorosulfonated polyethylenes, polysulfide elastomers, block copolymers, made up of segments of glassy or crystalline blocks such as polystyrene, poly(vinyltoluene), poly(t-butylstyrene), polyester and the like and the elastomeric blocks such as polybutadiene, polyisoprene, ethylene-propylene copolymers, ethylene-butylene copolymers, polyether ester and the like as for example the copolymers in poly(styrene-butadiene-styrene) block copolymer manufactured by Shell Chemical Company under the trade name of KRATON.

In one embodiment, the butyl rubber is present in the composition in the range of from about 45% to 65% of the total weight of the formulation. Stated another way, the butyl rubber could be present by percent weight of the formulation as follows: 45; 45.5; 46; 46.5; 47; 47.5; 48; 48.5; 49; 49.5; 50; 50.5; 51; 51.5; 52; 52.5; 53; 53.5; 54; 54.5; 56; 56.5; 57; 57.5; 58; 58.5; 59; 59.5; 60; 60.5; 61; 61.5; 62; 62.5; 63; 63.5; 64; 64.5; and about 65. In another embodiment, the butyl rubber can be present in the composition in the following weight percent: 45; 45.1; 45.2; 45.3; 64.7; 64.8; 64.9; and 65. The butyl rubber content could be present in a range defined by any two numbers above.

Phenol-Formaldehyde Resin

The curing agents may be phenols and phenol-formaldehyde resins produced by condensation of a phenol with formaldehyde in the presence of base. Typical agents include 2, 6-dihydroxymethyl-4-alkyl phenols and their polycyclic condensation polymers. Examples are given in U.S. Pat. No. 2,701,895. Curing occurs through the reaction of the methylol groups of the phenols or resin with the uncured rubber to form cross-linked structures.

In one embodiment, the polymeric composition is formed by curing the butyl rubbers with low amounts of phenol-formaldehyde resins with low levels of ether bridging. Such improved properties may include improved high-temperature ageing characteristics, faster cure rates, and better stress/strain properties. The polymeric composition may comprise such resin, an uncured butyl rubber, a halogen-containing compound and, optionally, a filler, and a process oil.

Base-catalyzed phenol-formaldehyde resins can be made by condensing a phenol with formaldehyde in the presence of base. The reaction results in the formation of phenol-alcohols which may subsequently undergo condensation reactions to form polycyclic phenols. An example of a polycyclic phenol-formaldehyde resin is given below:

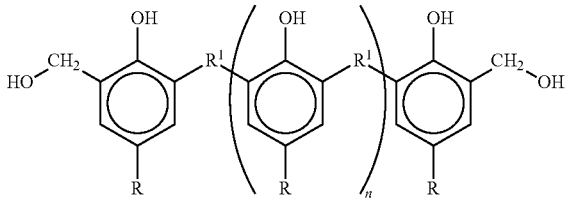

As shown, the phenol moieties are bridged by R'. These bridging moieties, R', may be the same or different and may be either methylene (—CH2-) or dimethylene ether (—CH2—O—CH2). The integer n may have values from o to 10, preferably o to 5. It is preferred that the integer n has a value sufficiently high that the resin is a solid. The group R is an alkyl, cycloalkyl, cycloalkylalkyl, aryl or aralkyl group. It may contain up to about twelve carbon atoms. In one embodiment, the R groups are alkyl groups containing up to 8 carbon atoms, especially methyl, tert-butyl and tert-octyl groups; see U.S. Pat. No. 2,701,895 for further examples, which are in incorporated by reference herein.

Resin-cured butyl rubbers with improved properties may be obtained by curing with phenol-formaldehyde resins with low levels of ether bridging. In one embodiment, the molar ratio of dimethylene ether bridges to methylene bridges in the phenol-formaldehyde resin is less than about 2.5:1, or less than about 1.7:1, most preferably less than about 1:1. Examples of suitable phenol-formaldehyde resins which may be used include the resin in which has a molar ratio of dimethylene ether bridges to methylene bridges of about 0.65:1.

In one embodiment, the butyl rubber composition requires a small amount of a diene comonomer, usually isoprene, so that the composition can undergo cross-linking, or curing. Grades of butyl rubber can be distinguished by their isoprene content and Mooney viscosity (related to the molecular weight). Examples of uncured butyl rubber may have from about 0.5 mol % to about 10 mol % isoprene with butyl rubbers containing from about 0.5 to about 2.5 mol % isoprene, or also from about 0.9 to about 2.1 mol % of isoprene. Mention is made particularly of butyl rubber having about 1-4 to about 1.6 mol % isoprene. Some suitable butyl rubbers have a Mooney viscosity of about 25 to 70, preferably about 30 to about 63 (RPML 1+8 @ 125° C.).

In one embodiment, a halogen is present in the formulation. Examples of halogen-containing compounds include organic compounds such as olefin-containing polymers having pendant chlorine atoms, such as polychloroprene, available under such trade-marks as Baypren (Bayer), Butachlor (Distagul) and Neoprene (DuPont). In one embodiment, the amount present in the formulation is within the range of about 1 to about 10 parts, or about 4 to about 6 parts, or about 5 parts by weight to about 95 parts of uncured butyl rubber. Alternatively, chlorine-containing salts, for example stannous chloride, can be used as the halogen-containing compound. It is possible that the required halogen, e.g., chlorine or bromine, atom is provided as a component of one of the other ingredients of the formulation, rather than being provided by a separately added compound. For instance, it is possible to use a chlorinated or brominated butyl rubber, or a chlorinated or brominated polycyclic phenol-formaldehyde resin, rather than a separately added compound such as polychloroprene or stannous chloride. In one embodiment, the unhalogenated butyl rubber and unhalogenated phenol-formaldehyde resin are used and that the halogen is added in, say, polychloroprene or stannous chloride.

As an alternative to the PF resin, one could use a haloalkylated PF resin, such as bromomethylated PF resin. The range of alkylation in the alkyl PF resin is from about 8% to 12.5%. The bromomethyl alkylated phenolic resins are described in U.S. Pat. No. 2,972,600, the contents of which are incorporated herein by reference, and are prepared by brominating a phenolic material selected from the group consisting of 2-hydroxymethyl 4-alkyl phenols, 2,6-dihydroxymethyl 4-alkyl phenols, resitols of such hydroxymethyl 4-alkyl phenols wherein the resitol has an average of up to 4 phenol units, and a mixture of a 4-alkyl phenol with 0.5 to 2.1 moles of formaldehyde per mole of said phenol, said alkyl group containing 4 to 20 carbon atoms and the average bromine content of the brominated material being from about 1 to about 9 percent.

In one embodiment, a low unsaturation butyl rubber containing a bromomethyl alkylated phenolic resin and a metal halide is used.

In one embodiment, the PF resin is present in the composition in the range of from about 5% to 15% of the total weight of the formulation. Stated another way, the PF resin could be present by percent weight of the formulation as follows: 5; 5.5; 6; 6.5; 7; 7.5; 8; 8.5; 9; 9.5; 10; 10.5; 11; 11.5; 12; 12.5; 13; 13.5; 14; 14.5; and 15.

In another embodiment, the PF resin can be present in the composition in the following weight percent: 5; 5.1; 5.2; 5.3; 14.7; 14.8; 14.9; and 15. The PF resin content could also be present in a range defined by any two numbers above.

Other Curing Agents

Butyl rubber compositions may also be crosslinked in a number of different ways. Sulfur both in the form of rubber makers sulfur (S8) or polymeric sulfur (insoluble sulfur) (Sx) along with various accelerators such as Thiazoles, Sulfenamides, Guanidines, Carbamates, Thiurams, Alkyl phenol disulfides, Thiomorpholines, Dioximes, Phosphorodithioates, Aniline and its derivatives.

Halogenated butyl rubbers including brominated isobutylene-co-para-methylstyrene (BIMSM) may also be used. Halogenated butyl rubber may also be crosslinked by thioureas, metal oxides or metal chlorides, or peroxides with co-agents.

Fillers

Fillers may be added to the formulation. Examples of fillers include talc, calcium carbonate, clay, silica, titanium dioxide, carbon black, aluminum silicate, hydrated aluminum silicate, kaolin, montmorillonite, calcium carbonate, and quartz.

The carbon black ranges from N-770 to N-110; in one embodiment, the carbon black is N-351, classified in accordance with ASTM D1765 (see Maurice Morton, "Rubber Technology" 3rd Edition, Chapman & Hall, New York, 1995, pages 69-70, hereby incorporated by reference). In another embodiment, the carbon black is N550.

In one embodiment, the filler is present in the amount of about 5% to about 45% of the total weight of the formulation. In another embodiment, more than one filler may be present with each filler in the amount of about 5% to about 45% of the total weight of the formulation. Stated another way, the filler could be present by percent weight of the formulation as follows: 5; 5.5; 6; 6.5; 7; 7.5; 8; 8.5; 9; 9.5; 10; 10.5; 11; 11.5; 12; 12.5; 13; 13.5; 14; 14.5; 15; 15.5; 16; 16.5; 17; 17.5; 18; 18.5; 19; 19.5; 20; 20.5; 21; 21.5; 22; 22.5; 23; 23.5; 24; 24.5; 25; 25.5; 26; 26.5; 27; 27.5; 28; 28.5; 29; 29.5; 30; 30.5; 31; 31.5; 32; 32.5; 33; 33.5; 34; 34.5; 35; 35.5; 36; 36.5; 37; 37.5; 38; 38.5; 39; 39.5; 40; 40.5; 41; 41.5; 42; 42.5; 43; 43.5; 44; 44.5; and 45.

In another embodiment, the filler or fillers individually can be present in the composition in the following weight percent: 5; 5.1; 5.2; 5.3, 44.7; 44.8; 44.9; and 45.

In one embodiment, the formulation contains more than one filler. In one embodiment the first filler is present in the formulation in the range of from about 5% to about 15% of the weight of the formulation. In the embodiment, where the second filler is present, the second filler is present in the range of from about 20% to 35% of the weight of the formulation.

The formulation of the may contain a process oil, and many suitable process oils are known to those skilled in the art. Examples of suitable process oils include castor oil and paraffinic oils.

Zinc oxide may be added as an activator, suitably in an amount of up to about 8 parts, preferably about 5 parts, per hundred parts of rubber. Stearic acid may also be added, to assist in solubilizing the zinc oxide in the formulation.

The butyl rubber formulation described may be made by mixing the components of the butyl rubber formulation described above, and additionally any other desired optional ingredients such as accelerator, extender, lubricant, plasticizer, and the like, in any convenient manner used in the rubber industry, e.g. on a mill or in an internal mixer.

Vulcanizates can be made from the formulation by converting the formulation to any desired shape and size, and vulcanizing at elevated temperatures.

In another aspect, the formulation includes uncured butyl rubber, a halogen-containing compound, and a polycyclic phenol-formaldehyde resin having dimethylene ether bridges and methylene bridges, wherein the molar ratio of dimethylene ether bridges to methylene bridges is less than about 2.5:1 and the ratio of uncured butyl rubber to said polycyclic phenol-formaldehyde resin is less than 10:1 and may be as little as 5:1.

The product can be formulated to facilitate formation of strips, sheets, tapes, rolls, films, forms, foams, molds, slabs, tapes, coatings, perforated sheets, corrugated structures, laminates, beads, spray foams and any desired shape for damping purposes.

In one aspect, a vibration damping composition comprises a carbon containing nano-material. In yet another aspect, a multilayer article comprises a vibration damping composition comprising a carbon containing nano-material.

In other embodiments, the compositions described herein may comprise a plurality of carbon containing nano-materials.

The carbon containing nano-materials used are not particularly limited. Carbon nanotubes may be single-walled carbon nanotubes (SWCNT) or double walled carbon nanotubes (DWCNT). The DWCNTs may be obtained by any means, including, for instance, catalytic chemical vapor deposition. Such preparations techniques may give approximately 80% DWCNTs, having a diameter ranging between 1 and 3 nm and a length that can reach 100 μm. The electrical conductivity of such nanotubes may be greater than 25 S/cm when they are pressed into the form of pellets.

Other carbon nanotubes include multi-walled nanotubes (MWCNTs). The MWCNTs may be obtained by vapor deposition in the presence of a supported catalyst, such as described in PCT published patent application WO03/002456A2. MWCNTs so prepared may show, by transmission electron microscopy, that close to 100% of the tubes are MWCNTs. Such MWCNTs may have a diameter ranging between 10 and 50 nm and a length that can attain 70 pm. The electrical conductivity of such MWCNTs may reach greater than 20 S/cm when pressed in the form of pellets.

The SWCNTs, DWCNTs, and MWCNTs may be purified by washing with acid solution (such as sulfuric acid and hydrochloric acid) so as to rid them of residual inorganic and metal impurities. SWCNTs may also be noncovalently modified by encasing the nanotubes within cross-linked, amphiphilic copolymer micelles, such as described by Kang and Taton in Journal of the American Chemical Society, vol. 125, 5650 (2003). In another embodiment, the carbon nanotubes may be surface-functionalized, for instance, as described by Wang, Iqbal, and Mitra in Journal of the American Chemical Society, vol. 128, 95 (2006).

Other carbon containing nano-materials include, for instance, carbon nanofibers.

An example of suitable nanofibers include sub-micron VaporGrown Carbon Fibers (s-VGCF) with very small diameters (20-80 nm), high aspect ratio (>100), and a highly graphitic structure (>60%) available as Grupo Antolin Carbon Nanofibers (GANF), from Grupo Antolin, Spain.

Alternatively, Pyrograf®-III is available in diameters ranging from 70 and 200 nanometers and a length estimated to be 50-100 microns available from Applied Sciences, Inc. (ASI) located in Cedarville, Ohio.

In yet further embodiments, the vibration damping compositions described herein may further comprise non-carbon containing nano-materials. Such materials include, for instance, silica nano-particles, zirconia nano-particles, and alumina nano-particles, TiO2, clay, indium tin(oxide), iron oxide, zinc oxide, and combinations thereof.

The compositions described herein may further comprise pigments, flow control additives, anti-oxidants, curative compounds, co-curatives, cure accelerators, inert fillers such as mineral fillers, flame retardants, processing aids such as extrusion aids (including fluoropolymer-based processing aids and lubricants such as mineral oils and waxes), glass bubbles, polymeric bubbles (such as Dualite® Hollow Composite Microsphere Fillers available from Pierce and Stevens, Corp., Buffalo, N.Y.) and other additives.

Shaped articles may also be formed which comprise a carbon containing nano-material; a curable matrix; and a block copolymer comprising a functional block and a non-functional block, wherein no block is compatible with the curable matrix. In these shaped articles, the carbon containing nano-materials may be dispersed in the curable matrix. In some embodiments, the curable matrix is electrically non-conductive, whereas the composite article itself is electrically conductive.

Shaped articles include, for instance, sleeves, shafts, handles, frames, struts, bodies and the like. In some embodiments, the compositions described herein allow for efficient and/or uniform dispersion of carbon containing nano-materials. This efficient dispersion may give rise to favorable properties, such as tensile strength, modulus improvements, flexibility, electrical conductivity, 5 thermal conductivity, and viscoelastic vibration damping.

In some embodiments, the cured compositions described herein have a tan delta value that is at least 20% higher than a comparable cured composition containing the cured matrix that lacks the carbon containing nano-materials as described herein. In other embodiments, the tan delta value of the cured compositions described herein is increased by 20% or more, 25% or more, 35% or more, or even 50% or more when compared to a cured composition containing the cured matrix that lacks the carbon containing nano-materials and block copolymer as described herein.

The polymeric compositions also may have antimicrobial properties. Thus, the formulation in one or more of the shapes desired can be used for dampening and impact modification as well as for additional microbial resistance this material has to offer. This material also in one embodiment has light-weight compared to the comparable product in the market as well as longer useful life.

Generally speaking, the polymeric composition offers one or more of the following physical characteristics in its use: impact dampening; sound dampening; vibration dissipation; cushioning for comfort; sound attenuation; light-weight; longer life; anti-microbial properties; resistance to air exposure; and UV resistance.

The use of the polymeric composition can be envisioned in a variety of fields. Some of the examples include grips for sporting equipment (tennis rackets, golf clubs, hockey sticks, mouth guards, football helmets, etc.), seats (for motorcycles or chairs), footwear (including shoe soles, inserts, toe pads, etc.), electronics (computers, cell phones, disk drives, etc.), vehicles, automobile interiors and roofs, kitchen appliances, outboard motors, braking systems, medical devices, etc. Further applications include automotive under hood insulation, automotive floor panels, bench top laboratory equipment, building wall panels, cell phone cases, compressor motors, coatings, computer pads, dishwasher walls, percussion (drum) dampeners, films, optical equipment, (laser), integrated components, medical devices, seat cushions, slab stock.

For example, from physical properties' standpoint of the polymeric composition, the following exemplary applications are identified:

Vibration

I. Bench top laboratory equipment isolation
II. Tennis Rackets Impact
III. Football Helmets
IV. Integrated systems manufacturers
V. Seat Cushions Sound
VI. Building Wall Panels
VII. Compressor Motors
VIII. Dishwasher Walls
IX. Drum Dampeners
X. Textiles and Surfaces
XI. Anti-microbial coatings or surfaces/disposable anti-microbial textiles Experimental-Evaluation of Damping Properties Several samples were analyzed using the Dynamic Mechanical Analyzer (DMA) to determine their tan Δ (tan delta) value, that is, the ratio of loss modulus E" to storage modulus E':

1. Material of the REB5A-55 with durometer A hardness of 55
2. Material of the REB5A-45 with durometer A hardness of 45
3. Comparative material-Otter Box phone case
4. Comparative material-Belkin phone case
5. Comparative material-Wilson yellow mouth guard
6. Comparative material-Riddell helmet and protective gear-black foam
7. Comparative material-Spalding neoprene material-black with blue backing square material
8. Comparative material-Moon Gel damper pad
9. Comparative material Sorbothane 0208060-50-10 (50 durometer hardness)

The REB5A materials were tested at two different hardness values (45 and 55 durometer A) and compared with materials available on market from competitors. Seven materials were tested for comparison purposes. The primary objective of the test was to obtain tan 6 and E' values from the nine samples at vibration frequencies of 10 Hz, 20 Hz, 50 Hz, and 100 Hz at room temperature (26±1° C.) using the DMA. These measurements were reported on the technical data sheets of competitive products. Tan δ, also known as damping factor in DMA terminology, is generally related to the energy damping properties of the material being tested. E' is the storage modulus and is related to the stiffness of the material. Tan d measures the ratio of the loss modulus E" to the storage modulus E'.

A Netzch 242 DMA was used in the tensile mode. Static force of 0 N and dynamic force of 5 N were used with a force factor of 1.01 and an amplitude of 50 μm. Testing was conducted at room temperature (26 ±1° C.) at frequencies of 10 Hz, 20 Hz, 50 Hz, and 100 Hz. Table 1 provides a summary of the DMA results; the results have been listed in order of highest to lowest tan 8 values. Table 2 calculates the percentage improvement in tan delta values of the materials of the present disclosure over the comparative materials.

The proprietary material at 45 and 55 durometer A hardness (REB5A-45 and REB5A-55) provided the highest tan 8 values out of all of the tested samples. Thus, these material would have superior mechanical energy damping properties at the tested conditions.

The storage modulus E' of the materials corresponded well with the physical stiffness of the samples. On the other hand, this stiffness represented by E' did not seem to correlate directly to the damping performance represented by tan δ. For example, a less stiff material (lower E' value) did not correspond to a higher level of damping (high tan δ value) as may be conventionally expected.

TABLE 1

| | | Storage Modulus E'(MPa) | | | | Tan Delta | | | |
|---|---|---|---|---|---|---|---|---|---|
| No. | Sample Description | 10 Hz | 20 Hz | 50 Hz | 100 Hz | Hz | 20 Hz | 50 Hz | 100 Hz |
| 1. | REB5A-55 | 10.187 | 11.569 | 13.875 | 16.692 | 0.516 | 0.586 | 0.709 | 0.832 |
| 2. | REB5A-45 | 7.164 | 7.908 | 9.144 | 10.435 | 0.415 | 0.467 | 0.581 | 0.708 |
| 3. | Sorbothane 0208060-50-10 | 0.821 | 0.896 | 1.002 | 0.877 | 0.275 | 0.312 | 0.476 | 0.590 |
| 4. | Moon Gel damper pads | 0.188 | 0.188 | 0.177 | 0.069 | 0.099 | 0.109 | 0.309 | 0.455 |
| 5. | Spalding neoprene | 0.959 | 0.974 | 1.002 | 0.771 | 0.178 | 0.175 | 0.272 | 0.298 |
| 6. | Riddell helmet and protective gear | 0.615 | 0.622 | 0.628 | 0-440 | 0.127 | 0.130 | 0.244 | 0.265 |
| 7. | Belkin phone case | 51.782 | 54.164 | 57.565 | 61.087 | 0.136 | 0.144 | 0.171 | 0.203 |
| 8. | Otter Box phone case | 13.360 | 13.979 | 14.906 | 15.635 | 0.126 | 0.131 | 0.159 | 0.195 |
| 9. | Wilson yellow mouth guard | 10.683 | 11.145 | 11.832 | 12.290 | 0.117 | 0.117 | 0.138 | 0.162 |

TABLE 2

Percent Improvement in Tan Delta of REB5A-45 Over Comparative Samples

| No. | Sample Description | % Improvement in Tan Delta Over Commercial Samples | | | |
|---|---|---|---|---|---|
| | | 10 Hz | 20 Hz | so Hz | 100 Hz |
| 3. | Sorbothane (Hardness 50) | 87.6 | 87.8 | 48.9 | 41.0 |
| 4. | Moon Gel damper pad | 421.0 | 437.6 | 129.4 | 82.9 |
| 5. | Spalding neoprene | 187.9 | 234.8 | 160.7 | 179.2 |
| 6. | Riddell helmet | 306.3 | 350.8 | 190.6 | 214.0 |
| 7. | Belkin phone case | 278.4 | 306.9 | 314.6 | 309.9 |
| 8. | Otter Box phone case | 309.5 | 347.3 | 365.9 | 326.7 |
| 9. | Wilson mouth guard | 341.0 | 400.8 | 413.8 | 413.6 |

TABLE 3

Percent Improvement in Tan Delta of REB5A-45 Over Comparative Samples

| No. | Sample Description | % Improvement in Tan Delta Over Commercial Samples | | | |
|---|---|---|---|---|---|
| | | 10 Hz | 20 Hz | 50 Hz | 100 Hz |
| 3. | Sorbothane (Hardness 50) | 50.9 | 49.7 | 22.1 | 20.0 |
| 4. | Moon Gel damper pad | 319.2 | 328.4 | 88.0 | 55.6 |
| 5. | Spalding neoprene | 133.1 | 166.9 | 113.6 | 137.6 |
| 6. | Riddell helmet | 226.8 | 259.2 | 138.1 | 167.0 |
| 7. | Belkin phone case | 205.1 | 224.3 | 239.8 | 248.8 |
| 8. | Otter Box phone case | 229.4 | 256.5 | 265.4 | 263.0 |
| 9. | Wilson mouth guard | 254.7 | 299.1 | 321.0 | 337.0 |

What is claimed is:

1. A sports equipment, comprising:

a racquet comprising a body having a head and a handle, the head comprising a beam having a beam inner surface;

a string on the beam, wherein a first portion of the beam inner surface is on a first side of the string and a second portion of the beam inner surface is on a second side of the string; and a vibration dampener comprising at least one elongated strip, wherein the at least one elongated strip comprises a first elongated strip, wherein the first elongated strip is attached to the first portion of the beam inner surface only on the first side of the string, and wherein the vibration dampener comprises a polymeric composition comprising a butyl rubber and a phenol-formaldehyde resin, wherein the butyl rubber is in a range from 45% to 65% by weight of the polymeric composition and the phenol-formaldehyde resin is in a range from 5% to 15% by weight of the polymeric composition.

2. The sports equipment of claim 1, wherein the polymeric composition is in direct contact with the beam inner surface.

3. The sports equipment of claim 1, wherein the at least one elongated strip comprises a second elongated strip attached to the second portion of the beam inner surface on the second side of the string.

4. The sports equipment of claim 1, wherein the elongated strip includes a layer of the polymer composition and an adhesive layer for attaching the elongated strip to the beam inner surface.

5. The sports equipment of claim 1, further including a second vibration dampener associated with handle.

6. The sports equipment of claim 5, wherein the second vibration dampener comprises a polymeric composition comprising a butyl rubber.

7. The sports equipment of claim 1, where in the sports equipment is a tennis racquet.

8. The sports equipment of claim 1, wherein said phenol-formaldehyde resin comprises a bromomethylated alkyl phenol-formaldehyde resin.

9. The sports equipment of claim 1, wherein the polymeric composition further comprises at least one filler.

10. The sports equipment of claim 9, wherein a content of the at least one filler is in a range of from 5% to 45% by weight of the polymeric composition.

11. The sports equipment of claim 1, wherein the polymeric composition has a shore A hardness in a range of from 35 to 65.

12. The sports equipment of claim 1, wherein the polymeric composition has a loss factor greater than 0.30 at 10 Hz and 0.60 at 100 Hz, wherein said loss factor is measured as a ratio of loss modulus and storage modulus in a dynamic mechanical analysis.

13. The sports equipment of claim 1, wherein said butyl rubber is an isobutylene/isoprene rubber.

14. A vibration dampener for equipment, comprising:

a layer configured to be attached to equipment, wherein the layer comprises a polymeric composition comprising: (i) a butyl rubber, wherein a content of the butyl rubber is in a range of from 45% to 65% by weight of the polymeric composition, and (ii) a phenol-formaldehyde resin, wherein a content of the phenol-formaldehyde resin is in a range of from 5% to 15% by weight of the polymeric composition.

15. The vibration dampener of claim 14, wherein the polymeric composition has a shore A hardness in a range of from 35 to 65.

16. The vibration dampener of claim 14, wherein the polymeric composition has a loss factor greater than 0.30 at 10 Hz and 0.60 at 100 Hz, wherein said loss factor is measured as a ratio of loss modulus and storage modulus in a dynamic mechanical analysis.

17. The vibration dampener of claim 14, wherein said phenol-formaldehyde resin comprises a bromomethylated alkyl phenol-formaldehyde resin.

18. The vibration dampener of claim 14, wherein the polymeric composition further comprises at least one filler.

19. The vibration dampener of claim 14, wherein a content of the at least one filler is in a range of from 5% to 45% by weight of the polymeric composition.

20. The vibration dampener of claim 14, wherein said butyl rubber is an isobutylene/isoprene rubber.

* * * * *